United States Patent [19]

Taylor

[11] Patent Number: 4,653,113

[45] Date of Patent: Mar. 24, 1987

[54] SECURITY BAG

[75] Inventor: Robert V. Taylor, Salisbury East, Australia

[73] Assignee: Techsearch Inc., Australia

[21] Appl. No.: 898,341

[22] Filed: Aug. 20, 1986

Related U.S. Application Data

[63] Continuation of Ser. No. 750,898, Jul. 1, 1985, abandoned.

[30] Foreign Application Priority Data

Jul. 2, 1984 [AU] Australia ..... PG5787

[51] Int. Cl.[4] ..... B65D 33/14

[52] U.S. Cl. ..... 383/5; 383/38; 383/61; 206/459; 206/807

[58] Field of Search ..... 206/459, 807; 383/5, 383/38, 40, 41, 52, 61, 67, 93, 94; 229/73, 83

[56] References Cited

U.S. PATENT DOCUMENTS

| | | | |
|---|---|---|---|
| 1,148,220 | 7/1915 | Dalton | 229/83 |
| 2,249,867 | 7/1941 | Snelling | 229/83 |
| 2,547,097 | 4/1951 | Schteldahl et al. | 383/61 |
| 2,819,010 | 1/1968 | Amiguet | 383/93 |
| 3,001,689 | 9/1961 | Burton | 383/94 |
| 3,036,616 | 5/1962 | Allen | 383/38 |
| 3,429,718 | 2/1969 | Helms | 383/40 |
| 3,520,472 | 7/1970 | Kukulski | 229/83 |
| 3,625,414 | 12/1971 | Caiola | 383/93 |
| 3,669,254 | 6/1972 | Chryanthis | 383/93 |
| 3,685,720 | 8/1972 | Brady | 206/459 |
| 3,827,625 | 8/1974 | Miller | 383/93 |
| 3,933,304 | 1/1976 | Judd | 383/5 |
| 4,098,577 | 7/1978 | Halpen | 206/807 |
| 4,483,018 | 11/1984 | Whelan | 383/5 |
| 4,488,646 | 12/1984 | McCorkle | 383/5 |
| 4,566,129 | 1/1986 | McNamee | 383/5 |

FOREIGN PATENT DOCUMENTS

| | | | |
|---|---|---|---|
| 2032882 | 5/1980 | United Kingdom | 383/5 |
| 2051003 | 1/1981 | United Kingdom | 383/5 |

OTHER PUBLICATIONS

Scientific Evidence in Criminal Cases, Moenssens et al. Chapter 1, pp. 18, 19, The Foundation Press Inc. 1973.

*Primary Examiner*—Joseph Man-Fu Moy
*Assistant Examiner*—David T. Fidei
*Attorney, Agent, or Firm*—Baker, Maxham & Jester

[57] ABSTRACT

A bag is formed of transparent polymeric material comprising a pair of side walls and a transverse weld forming a receptacle, and is characterized by a paper panel on the inner surface of one side wall, and a closure means comprising a plurality of strips of adhesive material, any one of which can join the other side wall to the paper panel in such a way that breaching of the adhesive material is evident by delaminating or tearing the panel.

6 Claims, 6 Drawing Figures

SECURITY BAG

This is a continuation of application Ser. No. 750,898 filed July 1, 1985 now abandoned.

This invention relates to a bag which is useful for containing a substance or article which may be required, for example, as an exhibit for legal evidential purposes, and therefore must be subject to strict security, and the invention extends to include a method of positive identification of such an exhibit.

BACKGROUND OF THE INVENTION

In the control of drug abuse, and in many other police activities, there is frequently a need for a bag to contain an exhibit, in such a way that it will become self-evident if the exhibit has been tampered with in any way. This is particularly desirable where the exhibit is required for evidential purposes.

This requirement has been recognised for a considerable period of time, but although bags are produced with barbed-type closures, nevertheless tampering is still possible and the main object of this invention is to provide improvements whereby a bag can be produced economically and yet give substantial security against tampering with the contents, unless such tampering becomes self-evident.

BRIEF SUMMARY OF THE INVENTION

In the invention a bag is formed of transparent polymeric material comprising a pair of side walls and transverse closure means forming a receptacle, and is characterised in that one of said closure means comprises at least one strip of adhesive material which joins the side walls in such a way that breaching of the adhesive material is evident.

With this arrangement it becomes possible for the bag to be initially sealed, for example immediately drugs are seized, and the contents to be examined and the bag to be subsequently re-sealed, retaining the identity of the contents under conditions of security.

BRIEF DESCRIPTION OF THE DRAWINGS

An embodiment of the invention is described hereunder in some detail with reference to, and is illustrated in, the accompanying drawings, in which.

Figures 1, 2, 3, 4, 5:
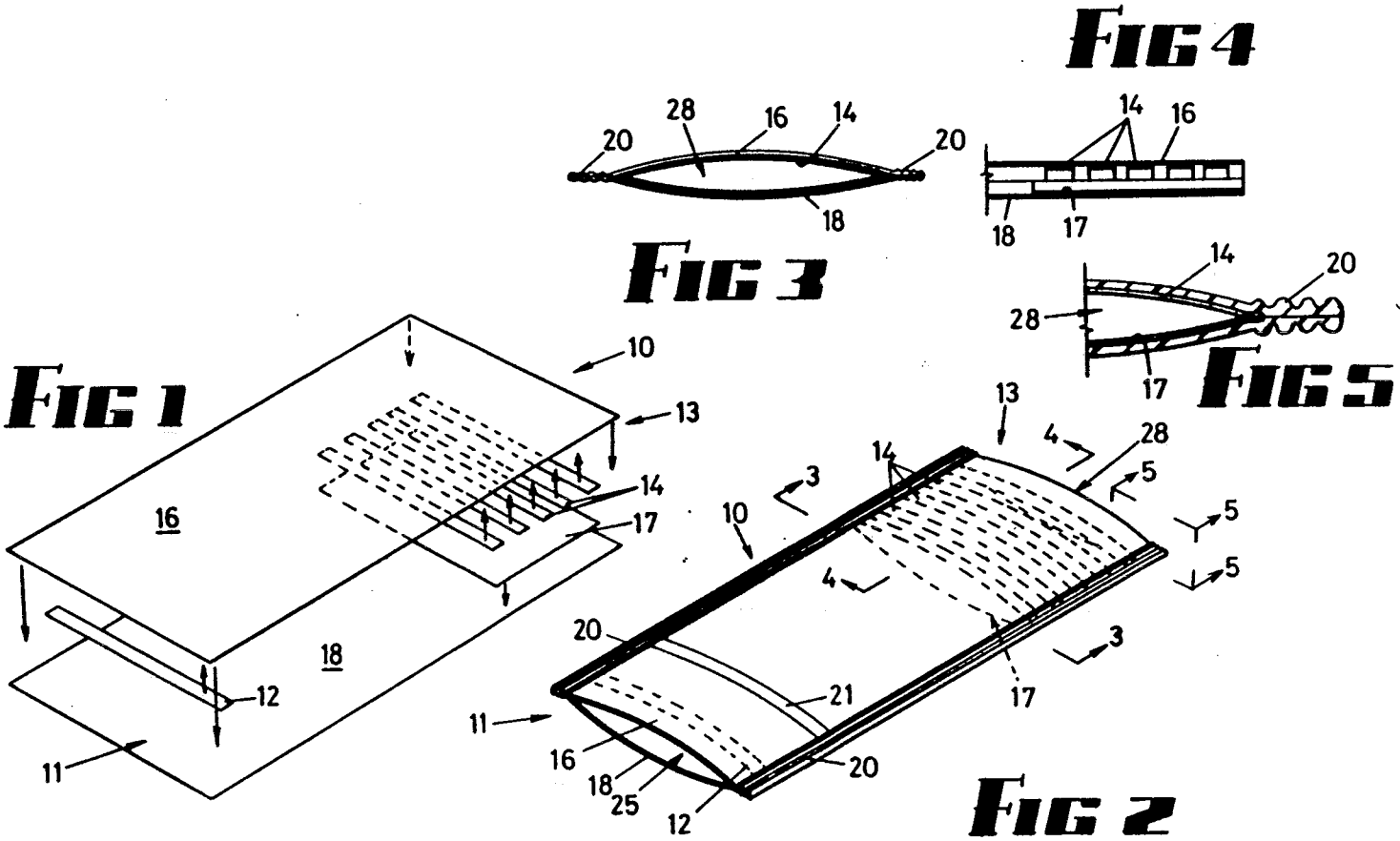
FIG. 1 is an "exploded" perspective view of a bag according to the invention.
FIG. 2 is a similar view showing the bag in its assembled state.
FIG. 3 is a section taken on line 3—3 of FIG. 2.
FIG. 4 is a section taken on line 4—4 of FIG. 2, drawn to an enlarged scale.
FIG. 5 is a section taken on line 5—5 of FIG. 2, drawn to a further enlarged scale.

In this embodiment a bag 10 is formed from clear thermoplastics material, (for example, polyvinyl chloride), and is provided at a pocket end 11 with a strip 12 of "SCOTCH" tape, and at the other (receptable) end 13 with a plurality of parallel strips 14.

In this embodiment the "SCOTCH" tape is an adhesive transfer tape identified by the designation 9471, and consists of a tape with an overlying non-adhesive paper which can be torn away to allow the tape adhesive to become effective. The word "SCOTCH" is a trade mark of Minnesota Mining & Manufacturing (Australia) Pty. Ltd. and tape is available from the said company at 24 Crittenden Road, Findon, State of South Australia. It is identified as a "Scotch Brand Product."

FIG. 1 illustrates five strips 14 which are first cemented to an upper wall 16 of the bag 10 at the receptacle end 13 thereof, and one further similar strip 12 cemented to the same wall 16 of the receptacle end 13. A paper panel 17 is cemented to the lower wall 18, and the paper panel 17 is formed from a material which alters colour if a solvent is used (purple, blue or other colour being typical). It also has a characteristic of delaminating if, after the strips 14 are adhered to the paper panel, they are removed. Additionally, the paper panel may utilize a perforated portion along which it will delaminate when taken off. Further, any other well known technique or expedient for causing delamination of the paper panel 17 may be used. Many such techniques are well known in the art. In this embodiment the paper is a white paper which is sold under the trade mark "SENSICHECK" and is available from Associated Pulp and Paper Mills, Paper Division, Bolong Road, Bomaderry, New South Wales. The adhesive which is used is sold under the trade mark "FASSONS" S260 and is selected because of its ability to cement the paper panel 17 to the lower wall 18 without discolouration of the paper panel. After the paper panel has been cemented, the upper and lower walls are joined by means of an RF weld both along the side edges 20 and also with a transverse intermediate weld 21 which is intermediate the ends of the bag 10 and divides it into its receptacle end 13 and its pocket end 11. The edge of this weld remote from the pocket is tapered so that it is not sharply defined. The side welds are about 5 mm wide and formed between sloping shoes so that the outer edge of the bag has minimal thickness and the inner edge of the weld is not sharply defined.

When prepared for use, the pocket end has part of a code label 23 inserted therein, the code label being torn at 24 and one portion remaining in the pocket 25 while the outer portion is retained. If desired, an instruction card 26 is also inserted into the pocket, although in the same embodiment the required instructions may be printed on the paper panel 17. The overlying paper strip of the adhesive strip 12 is then removed, and the pocket sealed by the adhesive strip with an effective seal. In addition to sealing by this means, heat sealing is applied to that end of the bag, which thereby becomes permanently closed. The adhesive is aggressive and will constitute an excellent adhesive both between the two surfaces of the polymeric material and the edge of the torn code label 23. The bag is then identified as an accountable item.

When siezed, the required exhibit is inserted into the receptable 28 of the bag 10, and the outermost adhesive strip 14 is exposed by tearing away the overlying non-adhesive paper strip. A first signature 29 and date is written on the paper panel, and the receptacle 28 is sealed by applying the adhesive strip over that signature, as shown in FIG. 6.

Figure 6:
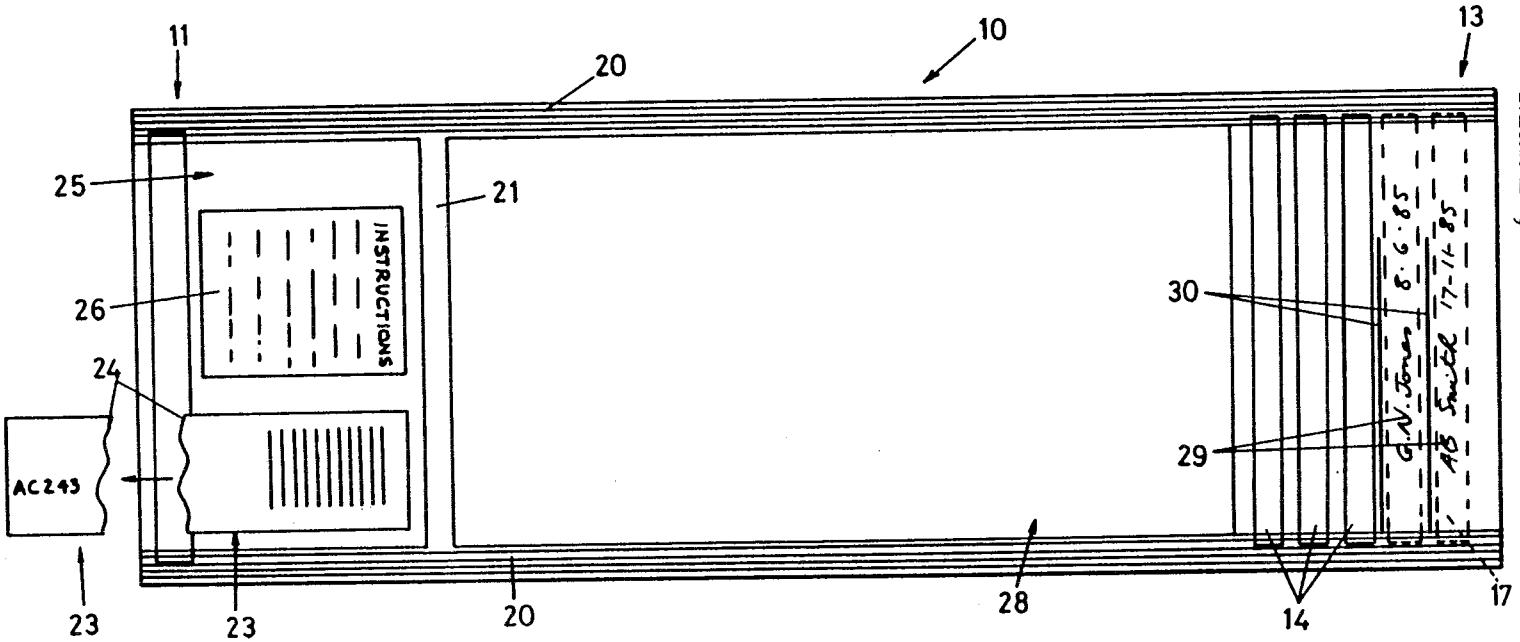
FIG. 6 is a plan view of the bag illustrating the method of use.

Also as shown in FIG. 6, when access is required to the receptacle 28, and first incision 30 is made in one of the walls 16 or 18, the exhibit is removed, say for analysis purposes, and the bag is resealed as before, again with a signature and date being written onto the paper panel before resealing as described above. This can be repeated four times and still leave a receptacle 28 containing at least some of the exhibit with a visible record of previous openings.

It is believed that the security offered by this invention is acceptable for the purpose of court proceedings, and yet the bag is one of relatively low cost which can be easily handled and used by simple obedience to the instructions which are printed, for example on the instruction card 26.

The invention will be seen to be particularly simple but nevertheless provides a bag which is useful in many applications, particularly for police work.

I claim:

1. A security bag having multiple sequential closure means defining tamper indicating means, said bag comprising:

a pair of opposed panels of polymeric transparent material joined along contiguous side edges defining opposed side walls thereby forming a receptacle opening having an opening at one end thereof;

a paper panel attached to the inner surface of one of said side walls adjacent the opening of said receptacle;

a plurality of spaced parallel adhesive closure strips extending transversely across and secured to the inner surface of the other of said side wall and overlying said paper panel, said paper panel adapted to receive indicia at the locality of each of said closure strips; and a plurality of non-adhesive strips, each protectively overlying a respective one of said adhesive strips and inhibiting adhesion thereof to said paper panel until torn away from the respective adhesive strip, whereupon the adhesive strips are adhesively secured to said paper panel, said paper panel defining a destructible closure and tamper indicating means whereby a portion of said paper panel containing said indicia associated with the respective one of said adhesive strips delaminates.

2. A bag according to claim 1 wherein said side walls are joined by a transversely extending seam weld between the side walls spaced longitudinally of the adhesive closure strips, and defining therewith said receptacle.

3. A bag according to claim 1 wherein said side walls are joined by a transverse seam weld which lies intermediate the ends of the bag and thereby forms a pocket opening to the other end of the bag, and a further adhesive closure strip at said other end closes said pocket when said strip adheres to both said side walls.

4. A bag according to claim 3 wherein all said adhesive closure strips are substantially identical.

5. A bag according to claim 1 wherein said paper panel is colour responsive to at least one solvent.

6. A security bag having multiple sequential closure means defining tamper indicating means, said bag comprising:

a pair of opposed panels of polymeric transparent material joined along contiguous side edges defining opposed side walls thereby forming a receptacle opening having an opening at one end thereof;

a paper panel attached to the inner surface of one of said side walls adjacent the opening of said receptacle;

a plurality of spaced parallel adhesive closure strips extending transversely across and secured to the inner surface of the other of said side wall and overlying said paper panel, said paper panel adapted to receive indicia at the locality of each of said closure strips;

a plurality of non-adhesive strips, each protectively overlying a respective one of said adhesive strips and inhibiting adhesion thereof to said paper panel until torn away from the respective adhesive strip, whereupon the adhesive strips are adhesively secured to said paper panel, said paper panel defining a destructible closure and tamper indicating means whereby a portion of said paper panel containing said indicia associated with the respective one of said adhesive strips delaminates;

a transverse seam weld joining said side walls intermediate the ends of the bag and thereby forms a pocket opening to the other end of the bag, and a further adhesive closure strip at said other end for closing said pocket when said strip adheres to both said side walls; and a code label for at least partially positioning in said pocket.

* * * * *